United States Patent [19]

Hofman

[11] Patent Number: 4,744,538

[45] Date of Patent: May 17, 1988

[54] DECORATIVE CAP AND BASE COVER FOR AN OFFICE CHAIR CENTER POST AND BASE

[75] Inventor: William K. Hofman, Coopersville, Mich.

[73] Assignee: The Shaw-Walker Company, Moskegon, Mich.

[21] Appl. No.: 47,287

[22] Filed: May 8, 1987

[51] Int. Cl.[4] ..... A47B 95/00

[52] U.S. Cl. ..... 248/345.1; 248/188.7

[58] Field of Search ..... 248/345.1, 188.7, 188.8, 248/188.9; 297/349, 411; 403/23, 50, 51

[56] References Cited

U.S. PATENT DOCUMENTS

| | | | |
|---|---|---|---|
| 3,289,995 | 12/1966 | Taylor . | |
| 3,643,905 | 2/1972 | Kint . | |
| 3,994,466 | 11/1976 | Troup . | |
| 4,262,871 | 4/1981 | Kolk et al. . | |
| 4,365,839 | 12/1982 | Strassle . | |
| 4,534,533 | 8/1985 | Doerner . | |
| 4,598,892 | 7/1986 | Franckowiak et al. | 248/188.7 X |

*Primary Examiner*—Ramon O. Ramirez

*Attorney, Agent, or Firm*—Kinzer, Plyer, Dorn, McEachran & Jambor

[57] ABSTRACT

A decorative telescoping cap, sleeve and base cover for an office chair center post and base. A tubular plastic sleeve surrounds the upper portion of the height adjustment mechanism cylinder extending above the hub of the metal base. The tubular plastic sleeve has an outwardly flaring shoulder at its lower end which engages and rests upon the central tubular hub of the metal base of the chair. A plastic cylindrical cap telescopes over the tubular plastic sleeve, with the height adjustment mechanism rod of the chair extending through a central opening in the top wall of the cap to engage the cylindrical cap to raise and lower its relative to the tubular plastic sleeve as the height adjustment rod is raised and lowered. A plastic cover is provided for the metal base of the chair, with the cover having a central hub portion which fits over the central tubular hub of the metal base of the chair and arms which fit over the arms of the metal base. The central hub portion of the cover has an inwardly projecting shoulder which fits over and engages the outwardly flaring shoulder of the tubular plastic sleeve to prevent the tubular plastic sleeve from lifting off the hub. The plastic cover is fastened to the metal base.

2 Claims, 2 Drawing Sheets

DECORATIVE CAP AND BASE COVER FOR AN OFFICE CHAIR CENTER POST AND BASE

BACKGROUND OF THE INVENTION

For many years office chair manufacturers provided metal bases on chairs, which bases were painted or plated with finishes of chrome, copper, nickel and stainless steel to obtain the proper aesthetic appearance and to resist wear and scratching. However, all of these finishes were eventually scuffed by contact with the shoes of the user. Accordingly, many chair manufacturers have covered their chair bases with a plastic cap or covering which is scuff-proof and is sufficiently soft so it does not unduly damage the shoes of the chair users. Some manufactureres also have provided a pair of telescoping sleeves or cans over the center post of the chair to conceal the unsightly height adjustment mechanisms which may be mechanical or pneumatic. For appearance sake, it is desirable that the telescoping sleeves have the same decorative appearance as the chair base cover.

One problem with the use of telescoping plastic sleeves or cans is that the bottom sleeve, which is supposed to remain stationary, sometimes moves as the height of the chair seat is adjusted, and exposes the height adjusting mechanism. Therefore, it is an object of this invention to provide a telescoping pair of sleeves for the chair center post and a chair base cover which holds the bottom sleeve in position.

Other objects may be found in the following specification, drawings and claims.

BRIEF DESCRIPTION OF THE DRAWINGS

The invention is illustrated more or less diagrammatically in the following drawings wherein.

DESCRIPTION OF THE PREFERRED EMBODIMENT

Figure 1:
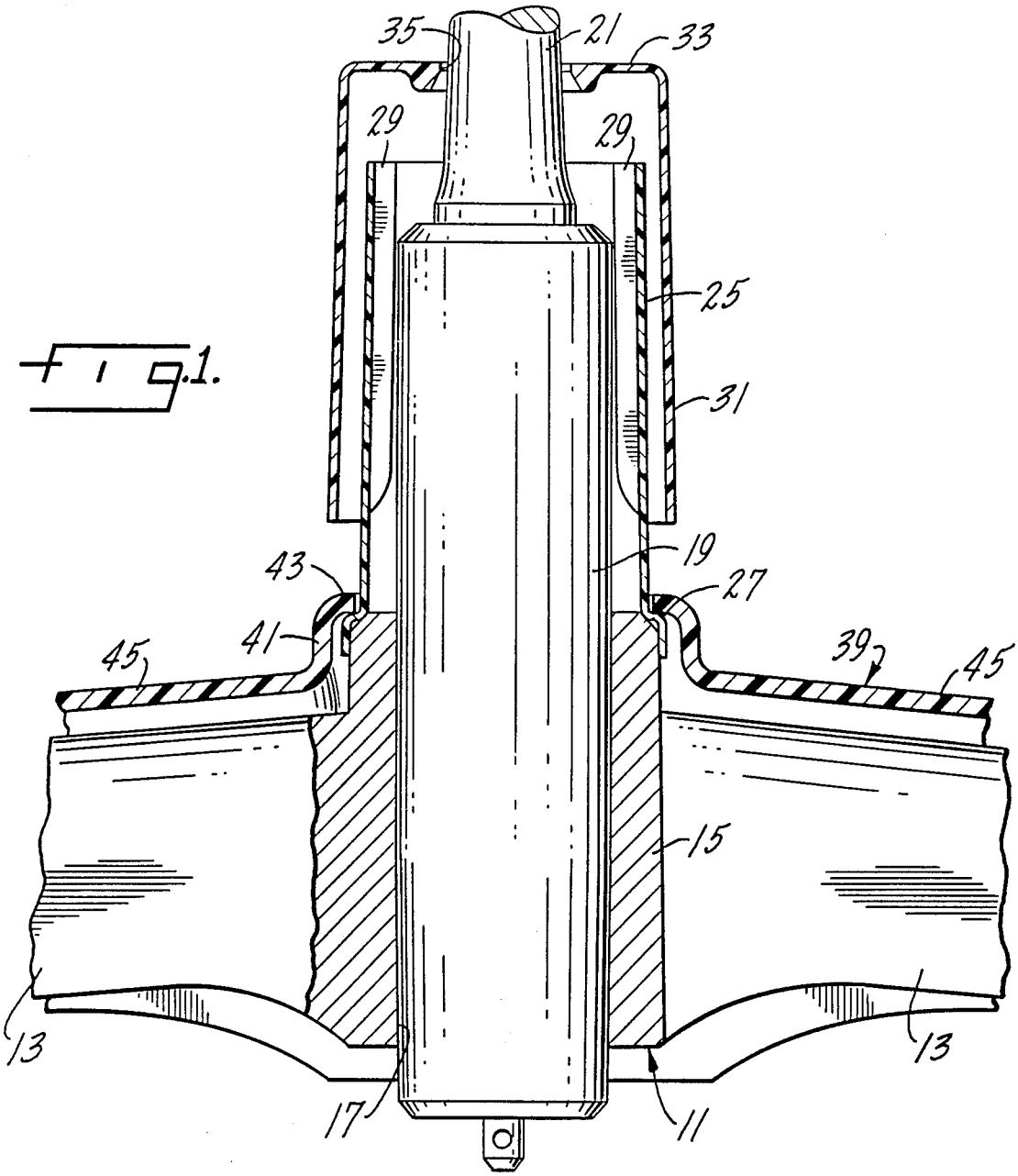
FIG. 1 is a partial, side elevational view of an office chair base and center post of this invention, with parts broken away and others shown in cross-section for clarity of illustration.
Figure 2:
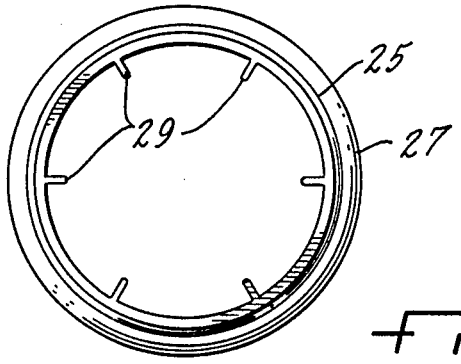
FIG. 2 is a top plan view of the inner sleeve of FIG. 1.
Figure 3:
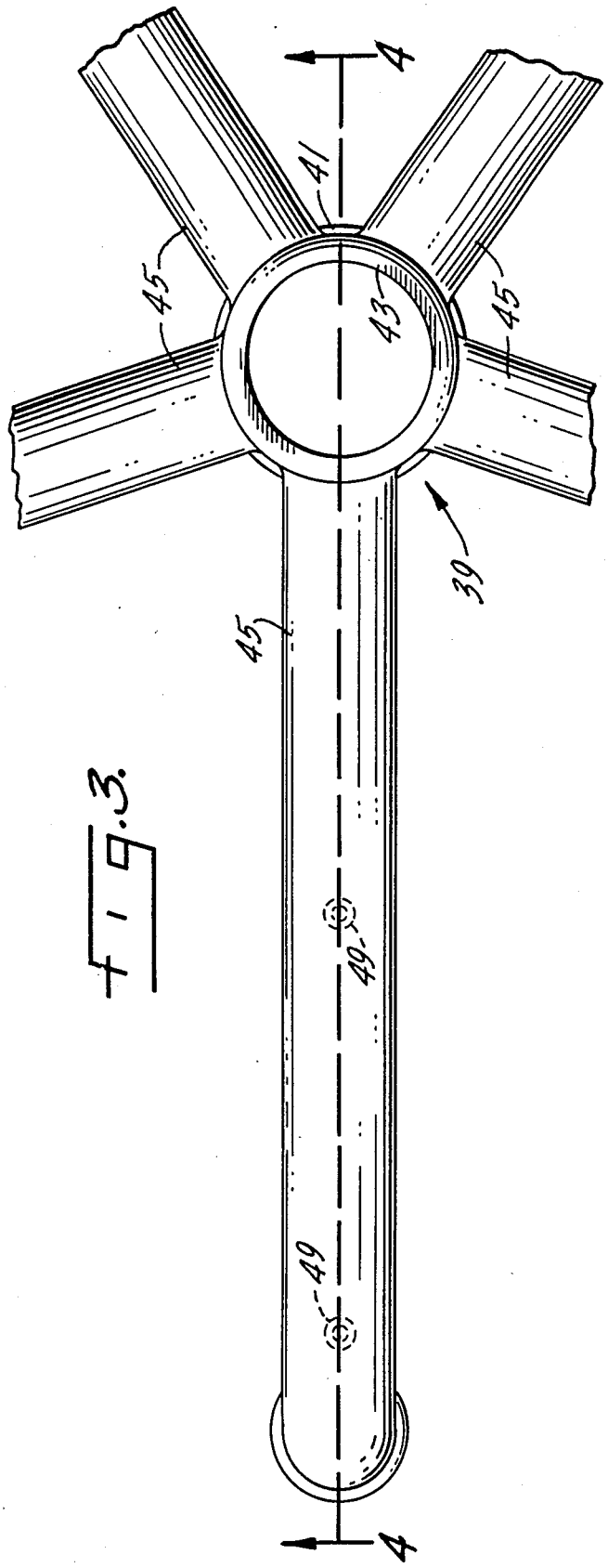
FIG. 3 is a partial, top plan view of the chair base cover.
Figure 4:
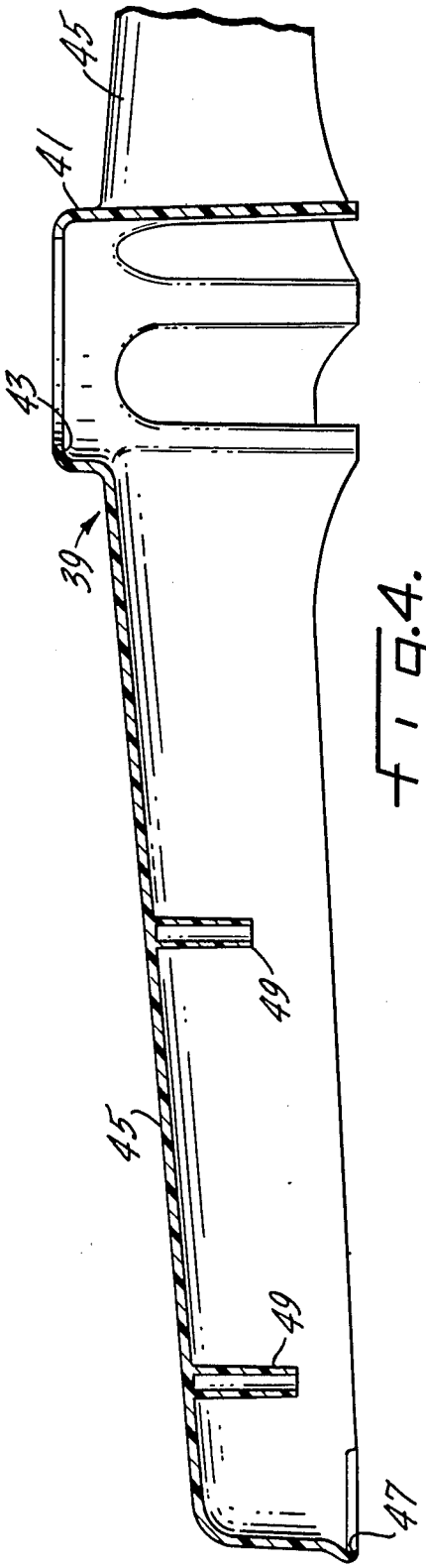
FIG. 4 is a cross-sectional view taken along line 4—4 of FIG. 3.

FIG. 1 of the drawings is a partial, cross-sectional view of a metal chair base 11 which normally has five arms 13 radiating from a central tubular hub 15. The metal chair base 11 is conventionally made of molded aluminum. Seated in the central, vertically extending passage 17 of the hub is a height adjusting mechanism cylinder 19 which extends upwardly beyond the top of the central tubular hub 15. The height adjustment mechanism cylinder has a rod 21 extending out of the top thereof which engages the underside of the chair seat assembly, which is not shown in these drawings for clarity of illustration. The height adjusting mechanism and its rod are commonly referred to as the chair center post.

To conceal the height adjustment mechanism cylinder 19 and its rod 21, a tubular plastic sleeve 25, preferably made of a material such as polypropylene, encircles the upper portion of the height adjustment mechanism cylinder 19 which extends beyond the hub 15. The tubular plastic sleeve 25 has an outwardly flaring shoulder 27 at its base, which shoulder rests on and engages the central tubular hub 15 of the metal chair base. The tubular plastic sleeve 25 is also formed with inwardly projecting ribs 29 evenly spaced around the interior perimeter thereof, which ribs engage the height adjustment mechanism cylinder 19 to position the sleeve in relation thereto. A plastic cylindrical cap 31, also formed of polypropylene, telescopes over the tubular plastic sleeve 25. The cap has a top wall 33 in which is formed an opening 35 through which the height adjustment mechanism cylinder rod 21 projects to engage the top wall of the cap to support the cap so that it telescopes up and down over the tubular plastic sleeve 25 as the height adjustment mechanism cylinder rod 21 moves up and down. The tubular plastic sleeve 25 and cap 31 should have the same outwardly appearance, color and finish for aesthetic purposes.

The metal chair base 11, arms 13 and central tubular hub 15 are provided with a base cap 39 formed of polypropylene of the same color and appearance as that of the plastic sleeve 25 and cap 31. The cap 39 has a central hub portion 41 with an inwardly projecting shoulder 43, which shoulder fits over the outwardly flaring shoulder 27 of the tubular plastic sleeve 25 to hold the tubular plastic sleeve in engagement with the central tubular hub 15 of the metal chair base 11. The base cap 39 has five arm portions 45 which extend over and cover the arms 13 of the metal chair base 11. Each arm is equipped with an inwardly turning lip 47 at its outer end which engages the outer end of an arm 13 of the chair base. Formed integrally with the arms 45 on the underside thereof are a pair of tubular mounting posts 49 which extend into openings in the chair base arms 13, not shown, and receive fasteners, not shown, to hold the base cap securely to the metal chair base.

I claim:

1. In an office chair having:

a metal base with a central tubular hub and a plurality of base arms extending radially from the central tubular hub, a height adjustment mechanism cylinder positioned in the central tubular hub with a portion of the cylinder extending above the hub, a rod extending upwardly from the height adjustment mechanism cylinder, a tubular plastic sleeve surrounding the upper portion of the height adjustment mechanism cylinder which extends above the hub, a plastic cylindrical cap telescoping over the tubular plastic sleeve, with the height adjustment mechanism rod extending through a central opening in the top wall of the cap to engage the cylindrical cap to raise and lower it relative to the tubular plastic sleeve as the height adjustment rod is raised and lowered, a plastic cover for the metal base, said cover having a central hub portion which fits over the central tubular hub of the metal base and arms which fit over the arms of the metal base, and means to fasten the plastic cover to the metal base, the improvement comprising an outwardly flaring shoulder formed on said tubular plastic sleeve at its lower end, which shoulder engages and rests upon the central tubular hub of the metal base, and an inwardly projecting shoulder formed integrally with the central hub portion of the plastic cover, which inwardly projecting shoulder fits over and engages the outwardly flaring shoulder of the tubular plastic sleeve to prevent the tubular plastic sleeve from lifting off the hub as the height adjusting rod is raised.

2. The office chair of claim 1 in which the tubular plastic sleeve has internally projecting ribs which engage the height adjustment mechanism cylinder in order to position the sleeve properly relative thereto.

* * * * *